United States Patent [19]

Takahashi et al.

[11] 4,444,549

[45] Apr. 24, 1984

[54] REFRIGERANT COMPRESSOR

[75] Inventors: Haruo Takahashi; Shogo Kimura, both of Gunma, Japan

[73] Assignee: Sanden Corporation, Japan

[21] Appl. No.: 286,592

[22] Filed: Jul. 24, 1981

[30] Foreign Application Priority Data

Aug. 4, 1980 [JP] Japan ..... 55-109730[U]

[51] Int. Cl.[3] ..... F04B 1/18; F04B 39/02

[52] U.S. Cl. ..... 417/269

[58] Field of Search ..... 417/269, 439

[56] References Cited

U.S. PATENT DOCUMENTS

| | | | |
|---|---|---|---|
| Re. 27,844 | 11/1968 | Olson, Jr. | 417/269 |
| 3,085,514 | 4/1963 | Budzich | 417/269 |
| 3,712,759 | 1/1973 | Olson, Jr. | 417/269 |
| 3,838,942 | 10/1974 | Pokorny | 417/269 |
| 3,945,765 | 3/1976 | Toyoda | 417/269 |
| 4,005,948 | 2/1977 | Hiraga et al. | 417/269 |
| 4,095,921 | 6/1978 | Hiraga | 417/269 |
| 4,236,878 | 12/1980 | Terouchi | 417/269 |
| 4,326,838 | 4/1982 | Kawashima | 417/269 |

FOREIGN PATENT DOCUMENTS

| | | | |
|---|---|---|---|
| 55-19917 | 2/1980 | Japan | 417/269 |
| 484114 | 5/1938 | United Kingdom | 417/269 |

*Primary Examiner*—William L. Freeh

*Attorney, Agent, or Firm*—Schuyler, Banner, Birch, McKie & Beckett

[57] ABSTRACT

A refrigerant compressor having pistons reciprocated in respective cylinders by a wobble plate driven by an input rotor which is secured on a drive shaft, in which improved refrigerant gas flow within the housing is achieved. A balance hole is provided for returning the blow-by gas, which is leaked from the cylinders through the gaps between the cylinders and pistons to the crank chamber, to the compressor suction chamber from the crank chamber. The balance hole comprises a first fluid passageway formed in a front end plate and a second fluid passageway connected between the first fluid passageway and the suction chamber. One end of the first fluid passageway opens into a hollow portion formed on a axial end surface of the input rotor. The rotor is formed with at least one opening at its outer peripheral surface which communicates between the crank chamber and the hollow portion. Therefore, the amount of lubricating oil which is discharged together with the returned blow-by gas through the balance hole is reduced.

5 Claims, 4 Drawing Figures

REFRIGERANT COMPRESSOR

BACKGROUND OF THE INVENTION

The present invention relates generally to fluid compressors, and more particularly, to an improvement in refrigerant compressors of the wobble type in which pistons are reciprocated by a wobble plate driven by a cam rotor which is secured to a drive shaft.

A wobble type compressor of this type is described in U.S. Pat. No. Re. 27,844 to Olson, which is incorporated herein by reference. In such a compressor, a wedge-shaped cam rotor is secured at the inner end of a drive shaft and is sandwiched between a wobble plate and front end plate, which rotatably supports the drive shaft. The wobble plate is connected to the pistons through connecting rods, is pivotally supported, and is prevented from rotating by suitable means. Therefore, the wobble plate can undergo oscillating or nutating movement following the rotation of the cam rotor, and the pistons slide within their cylinders. The wobble type compressor is small in size and is suitable for refrigeration systems in automobiles.

In the conventional refrigerant compressor, a charge of refrigerant gas and lubricating oil is maintained in the system. The refrigerant gas is compressed by a plurality of pistons which axially reciprocate within a corresponding plurality of cylinders. The reciprocal movement of the piston is, in turn, produced by the cooperation of the rotating cam rotor and the rotating wobble plate, which convert the rotation of the drive shaft to the desired reciprocal movement of the pistons. The compressed refrigerant gas together with the lubricating oil is forced out of the compressor to the refrigerant system and a quantity of lubricating oil is separated from the suction gas and passed into the compressor to lubricate desired components of the compressor.

It is desirable in the operation of such compressor that the amount of lubricating oil circulating in the compressor be proportional to the compressor operating speed. Moreover, it is generally desirable to utilize a minimum amount of lubricating oil and to minimize, if not prevent, the discharge of lubricating oil from the compressor to the refrigerant system. Reduction of the discharge of oil increases the operating efficiency of the condensor and evaporator, which are parts of the refrigerant system.

One recent attempt to improve the lubrication of a refrigerant compressor and minimize the discharge of lubricating oil therefrom is described in U.S. Pat. No. 4,005,948 to Hiraga, which is incorporated herein by reference. This patent discloses a lubricating system including a deflector projecting from the inner wall of the compressor housing which collects the lubricating oil splashed onto the housing wall and channels the lubricating oil thus collected to the shaft seal cavity. Therefore, the lubricating oil in a crank chamber is agitated by the movement of the cam rotor or the wobble plate and lubricates the internal moving parts in the form of an oil mist. A portion of the oil which flows along the inner surface of the compressor housing is collected by the deflector and flows into the shaft seal cavity to lubricate the shaft seal assembly.

In this construction, the discharge of lubricating oil can be reduced. However, generally a compressor is provided with a passageway or a balance hole to communicate the crank chamber with the suction chamber. This balance hole is provided to return the refrigerant "blow-by" gas in the crank chamber, which is leaked from the cylinders to the crank chamber through the gap between the inner surface of the cylinder and the piston, to the suction chamber. A portion of the lubricating oil is thus discharged through the balance hole to the suction chamber together with the returned blow-by gas. In particular, if the compressor is driven at high speed, the amount of blow-by gas leaked to the crank chamber is increased, and the velocity of flow in the balance hole is increased. The amount of discharged oil together with the refrigerant gas is, therefore, increased.

The prior art compressors thus require a relatively large amount of lubricating oil, which reduces the efficiency of operation of the refrigerant system of which the compressor is a part, while still not ensuring a sufficient amount of lubricating oil at all times during compressor operation. The known refrigerant compressors of the type described are thus subject to failure and reduced operating efficiencies.

SUMMARY OF THE INVENTION

It is a primary object of this invention to provide an improvement in a refrigerant compressor wherein the discharge of lubricating oil from the compressor is substantially reduced with a simple construction.

It is another object of this invention to provide a refrigerant compressor in which the total of lubricating oil is reduced, and a small amount of lubricating oil is effectively utilized.

According to one aspect of this invention, a refrigerant compressor including a compressor housing has a cylinder block provided with a plurality of cylinders and a crank chamber adjacent the cylinder block. A piston is slidably fitted within each of the cylinders and is reciprocated by means of a wobble plate means driven by an input rotor means. An input drive shaft means is connected to the rotor means at its inner end. A front end plate means is disposed on an opening of the crank chamber, and a bearing means is provided for rotatably supporting the drive shaft. A cylinder head means disposed on the opposite end portion of the housing includes a refrigerant suction and discharge chamber. A balance hole means is formed within the compressor for communicating the crank chamber with the suction chamber. The rotor means is formed with a hollow portion at an axial end surface thereof facing the inner surface of the front end plate means, and at least one hole is provided for interconnecting the hollow space and the crank chamber. One end of the balance hole means opens into the hollow portion through the inner surface of the front end plate means. The other end of the balance hole means opens with the suction chamber.

Further objects, features and other aspects of the invention will be understood from the following detailed description of the preferred embodiments of this invention when read in conjunction with the annexed drawings.

DETAILED DESCRIPTION OF THE PREFERRED EMBODIMENTS

Figure 1:
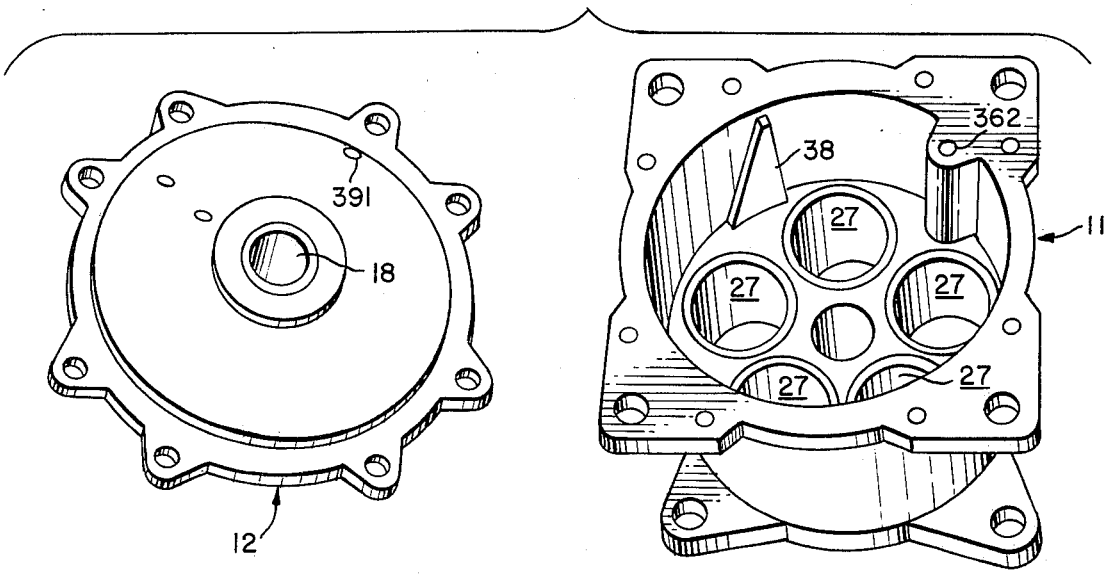
FIG. 1 is an exploded view showing in perspective the front housing and the interior of the cylinder housing of a compressor according to one embodiment of this invention.
Figure 2:
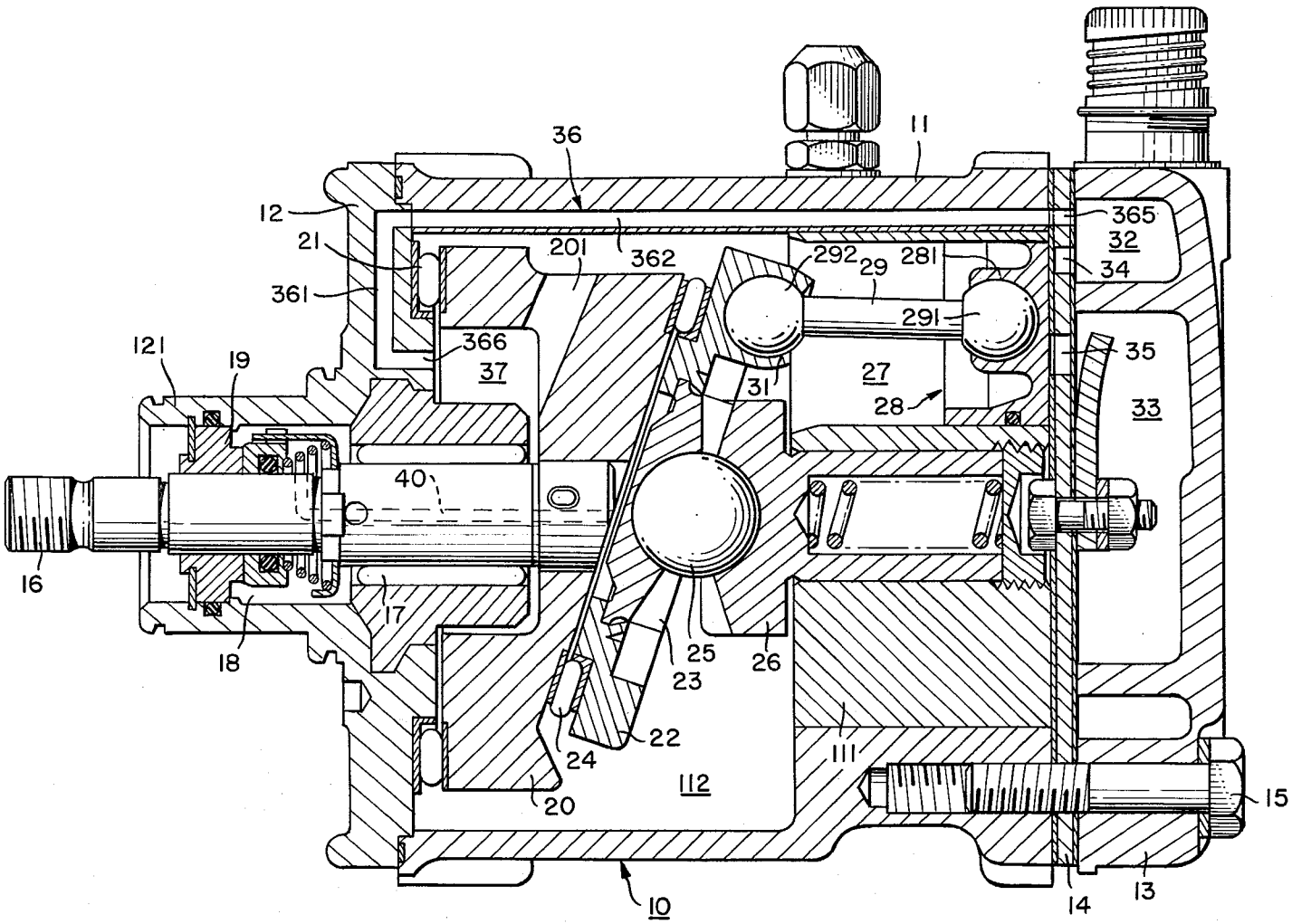
FIG. 2 is a vertical cross-sectional view of a refrigerant compressor according to the embodiment in FIG. 1.

Referring to FIGS. 1 and 2, a refrigerant compressor according to the invention is shown. The compressor, generally designated 10, comprises a cylindrical housing 11 having a cylinder block 111 in one end portion thereof, a hollow portion, such as a crank chamber 112 at the other end portion, a front end plate 12 and a cylinder head 13.

The left end portion of crank chamber 112 mounts front end plate 12 by a plurality of screws (not shown), and one end portion of cylinder block 111 mounts cylinder head 13 together with a valve plate means 14 by a plurality of screws 15 (one of which is shown in FIG. 2) to complete a closed housing assembly for the compressor. An opening is formed in front end plate 12 and a drive shaft 16 is rotatably supported by a bearing means, such as a radial needle bearing 17, which is disposed in the opening. Front end plate 12 has an annular sleeve portion 121 projecting from the front surface thereof and surrounding drive shaft 16 to define a shaft seal cavity 18. A shaft seal assembly 19 is disposed on drive shaft 16 within seal cavity 18.

At its inner end, drive shaft 16 is attached by any suitable means to a swash plate or cam rotor 20, such that cam rotor 20 is rotated along with shaft 16, and a thrust needle bearing 21 is disposed between the inner surface of front end plate 12 and the adjacent axial end surface of cam rotor 20. The outer end of shaft 16, which extends outwardly from the housing, is adapted to be driven by the motor of the vehicle in which the compressor is contained through a conventional clutch and pulley connection.

The sloping surface of cam rotor 20 is placed in close proximity to the surface of a wobble plate 22 mounted on an oscillating bevel gear 23, engaged by a thrust needle bearing 24. The latter is able to nutate or oscillate about a ball bearing 25 seated within a fixed bevel gear 26. The engagement of bevel gears 23 and 26 prevents rotation of wobble plate 22, as described in the aforementioned Olson and Hiraga patents.

Cylinder block 111 is formed with a plurality of annularly arranged cylinders 27, in which pistons 28 are slidably fitted. A typical arrangement would include five cylinders as illustrated in FIG. 1, but a smaller or larger number of cylinders may be provided. All pistons 28 are connected to wobble plate 22 by connecting rods 29. A ball 291 at one end of rod 29 is received in a socket 281 formed in piston 28, and a ball 292 at the other end of rod 29 is received in a socket 31 formed in wobble plate 22. It should be understood that although only one such ball socket connection is shown in FIG. 2, in the embodiment shown there are a plurality of sockets arranged peripherally around wobble plate 22 to respectively receive the balls of the various rods, and that each of pistons 28 is formed with a socket for receiving the other ball of the rod.

Cylinder head 13 of the compressor is shaped to define a suction chamber 32 and a discharge chamber 33. Valve plate means 14, which is secured to the end portion of cylinder block 111 by screw 15 together with cylinder head 13, is provided with a plurality of valved suction ports 34 connecting between suction chamber 32 and the respective cylinders 27, and a plurality of valved discharge ports 35 connecting between discharge chamber 33 and the respective cylinders 27. Suitable reed valves for suction ports 34 and discharge ports 35 are described in U.S. Pat. No. 4,011,029 to Shimizu, incorporated herein by reference.

In operation, drive shaft 16 is rotated by the motor of the vehicle, and cam rotor 20 is rotated together with shaft 16 to cause non-rotatable, wobbling motion of wobble plate 22 about ball bearing 25. As wobble plate 22 moves, pistons 28 are reciprocated out of phase in their respective cylinders 27. By the reciprocation of the pistons, refrigerant gas is taken into, compressed and discharged from the cylinders.

A quantity of lubricating oil is charged within crank chamber 112. Therefore, the lubricating oil in crank chamber 112 is agitated by the movement of cam rotor 20 and wobble plate 22, and lubricates the internal moving parts in the form of an oil mist. In order to efficiently use oil in crank chamber 112 for lubricating the shaft seal assembly and the other moving parts, a lubricating system is provided which is similar to that described in the aforesaid U.S. Pat. No. 4,005,948 to Hiraga. This lubricating system is described below and in the aforementioned Hiraga patent.

Figure 3:
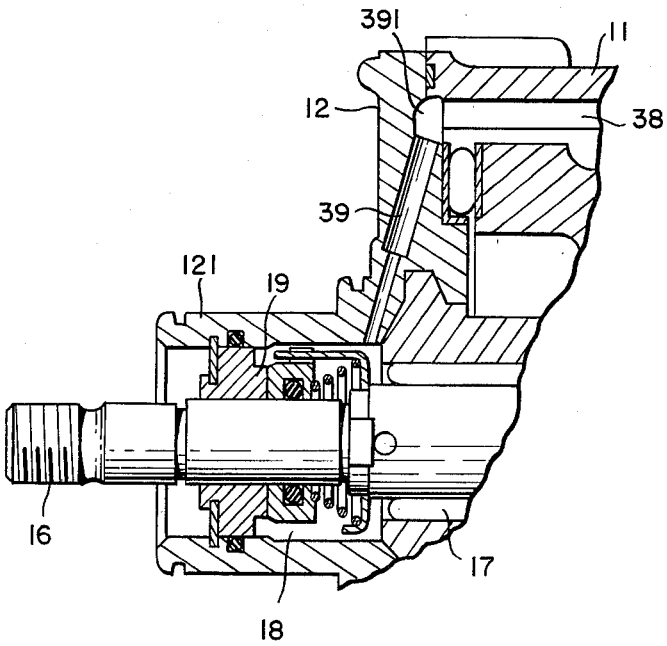
FIG. 3 is a vertical sectional view of a portion of a refrigerant compressor according to the embodiment in FIG. 1, illustrating the lubricating system.

Referring to FIG. 3, an oil deflector 38 projects into the crank chamber 112 from the inner wall of the compressor housing 11. Deflector 38 may be in the form of a right triangle having a surface which tapers toward the front end plate 12 of the housing and terminates in a flat tip which touches the inner wall of front end plate 12 adjacent but offset from an oil opening 391 formed in front end plate 12. Opening 391 communicates with shaft seal cavity 18 through an oil passageway 39 formed in the interior of front end plate 12 and terminating at its lower end at the shaft seal cavity 18. Shaft seal cavity 18 also communicates with the crank chamber 112 through an oil passageway 40 formed axially in drive shaft 16.

According to such a construction, the lubricating oil within the crank chamber 112 splashed onto the interior wall of the housing by the rotation of cam rotor 20 is collected along the tapered surface of deflector 38 and is thereby directed to flow along that surface to opening 391 into which the collected oil is passed. The lubricating oil that is directed in this manner to opening 391 flows through oil passageway 39 into shaft seal cavity 18. One portion of the lubricating oil within shaft seal cavity 18 flows through passageway 40 of the drive shaft 16 to thrust bearing 24 and ball bearing 25, and to crank chamber 112. Another portion of the oil flows through a clearance between the needle rollers of thrust bearing 17 to thrust bearing 21, and to crank chamber 112.

Figure 4:
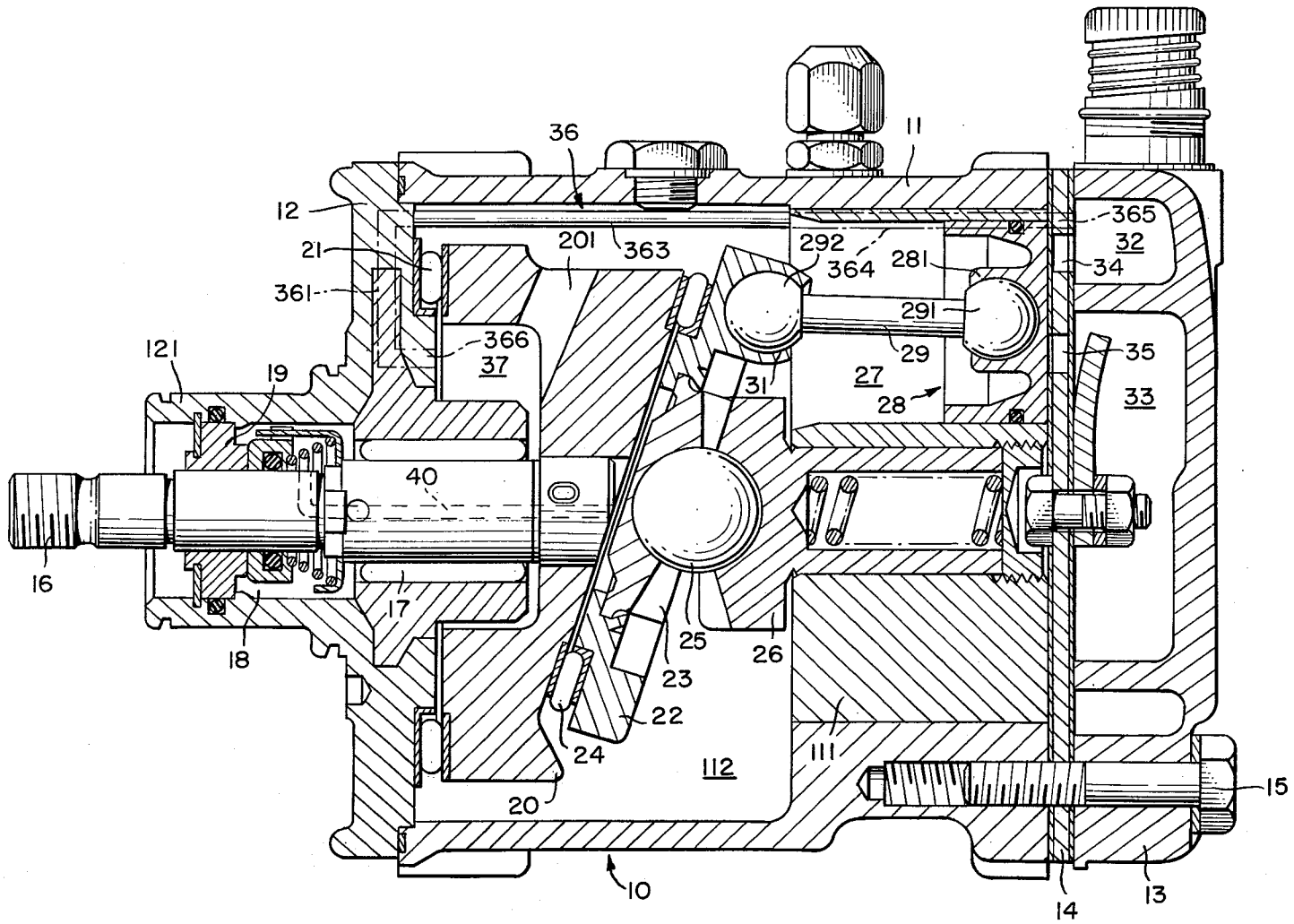
FIG. 4 is a vertical cross-sectional view of a refrigerant compressor according to another embodiment of this invention.

Now, the compressor is provided with a balance hole 36 which communicates with the crank chamber 112 and suction chamber 32 to return the blow-by gas from crank chamber 112 to suction chamber 32. Balance hole 36 comprises a fluid passageway 361 formed in front end plate 12 and a connecting way 362 formed as a bore (FIG. 2) in housing 11 which extends along the crank chamber 112 and communicates with suction chamber 32 through a hole 365 in valve plate means 14. Alternatively, connecting way 362 may be formed within crank chamber 112 as a connecting tube 363 (FIG. 4) extending from passageway 361 to a bore 364 formed in housing 11 adjacent cylinder block 111. Bore 364 communicates with suction chamber 32 through a hole 365 in valve plate means 14, as shown in FIG. 4.

The other end of fluid passageway 361 opens through the inner surface of front end plate 12 as a port 366 facing a hollow portion 37 formed on the axial end surface of cam rotor 20. The outer peripheral surface of cam rotor 20 is formed with an opening 201 which communicates the crank chamber 112 and hollow portion 37. Thus, the blow-by gas in crank chamber 112, which is leaked from the cylinders through the gaps between the inner surface of cylinders 27 and pistons 28 to crank chamber 112, can be returned to suction chamber 32 through the opening 201 of cam rotor 20, hollow portion 37, and balance hole 36.

During operation of the compressor, the oil-refrigerant fluid mixture will flow into hollow space 37 of cam rotor 20 through the opening 201 of cam rotor 20. The oil included in the fluid mixture is separated when struck by the cam rotor 20 and splashed outwardly by the rotation of cam rotor 20. The lubricating oil flows from shaft seal cavity 18 through the clearance of needle bearing 17 to the gap between the inner surface of front end plate 12 and the axial end surface of cam rotor 20, and is splashed outwardly by the centrifugal force due to the rotation of cam rotor 20. Oil flowing along the inner wall of the housing 11 is kept from entering the hollow portion 37 by centrifugal force of rotating cam rotor 20.

Therefore, the amount of lubricating oil within hollow portion 37 is minimized, and the oil discharged from the compressor through balance hole 36 together with the refrigerant gas is thus minimized.

Furthermore, the pressure in hollow portion 37 would be lower than in crank chamber 112 since the blow-by gas is sucked through balance hole 36. The circulation of the lubricating oil between shaft seal cavity 18 and crank chamber 112, in particular through the clearance of needle bearing 17, is thus improved.

Although the invention has been described in detail in connection with a preferred embodiment, it will be understood by those skilled in the art that this embodiment is only for exemplification, and that various further modifications may be made therein without departing from the scope of this invention, which is limited by the appended claims.

We claim:

1. In a refrigerant compressor including a compressor housing having a cylinder block provided with a plurality of cylinders and a crank chamber adjacent said cylinder block, a piston slidably fitted within each of said cylinders and reciprocated by means of a wobble plate means driven by an input rotor means and an input shaft means connected with said rotor means, a front end plate means on said housing including a bearing means for rotatably supporting said input shaft, a cylinder head means at the opposite end of said housing including a refrigerant suction and discharge chamber, and a balance hole means for communicating said crank chamber and said suction chamber, the improvement wherein said input rotor is formed with a hollow portion at the axial end surface thereof which faces the inner surface of said front end plate means and at least one opening for communicating said hollow portion with said crank chamber, said balance hole means includes at one end thereof a first fluid passageway in said end plate means which opens as a port facing said hollow portion through the inner surface of said front end plate means, and the other end of said balance hole means opens into said suction chamber.

2. The improvement as claimed in claim 1, wherein said balance hole means comprises a connecting tube extending along said housing and connected at one end to said first passageway and at the other end to said suction chamber.

3. The improvement as claimed in claim 1, wherein said balance hole means comprises a second fluid passageway formed in said housing.

4. The improvement as claimed in claim 1, wherein said balance hole means comprises a second fluid passageway formed in said housing, and a connecting tube connected between said first and second fluid passageways.

5. The improvement as claimed in claim 1, further comprising a shaft seal assembly mounted on said input shaft and within a shaft seal cavity formed in said front end plate means, an oil deflector extending from the inner wall of said housing, said front end plate means including an oil opening disposed adjacent said oil deflector and an oil passageway formed in said front end plate means effecting oil communication between said oil opening and said shaft seal cavity, and means for effecting lubricating oil communication between said shaft seal cavity and said crank chamber of said housing.

* * * * *